US005908030A

United States Patent [19]

Coi et al.

[11] Patent Number: 5,908,030

[45] Date of Patent: Jun. 1, 1999

[54] DEVICE FOR TRANSFERRING CIGARETTE PORTIONS FROM A DUAL-ROD CIGARETTE MANUFACTURING MACHINE TO A FILTER ASSEMBLY MACHINE

[75] Inventors: Daniele Coi, Bologna; Fiorenzo Draghetti, Medicina, both of Italy

[73] Assignee: G.D Societa' per Azioni, Bologna, Italy

[21] Appl. No.: 08/955,035

[22] Filed: Oct. 21, 1997

[51] Int. Cl.[6] ..... A24C 5/47

[52] U.S. Cl. ..... 131/94; 131/84.1; 198/433; 198/471.1

[58] Field of Search ..... 198/450, 471.1, 198/475.1, 441, 951, 377, 457, 433; 131/94, 84.1, 84.4, 282

[56] References Cited

U.S. PATENT DOCUMENTS

| | | | |
|---|---|---|---|
| 4,645,063 | 2/1987 | Seragnoli | 198/450 |
| 5,255,777 | 10/1993 | Pawelko . | |
| 5,267,577 | 12/1993 | Rizzoli et al. . | |
| 5,381,884 | 1/1995 | Spatafora et al. | 198/433 |
| 5,390,684 | 2/1995 | Rizzoli et al. | 131/94 |

FOREIGN PATENT DOCUMENTS

| | | |
|---|---|---|
| 2516901 | 5/1983 | France . |
| 2099780 | 12/1982 | United Kingdom . |

*Primary Examiner*—Aaron J. Lewis
*Assistant Examiner*—Charles Anderson
*Attorney, Agent, or Firm*—Marshall, O'Toole, Gerstein, Murray & Borun

[57] ABSTRACT

A device for transferring cigarette portions from an output bed of a dual-rod manufacturing machine to an input roller of a filter assembly machine; the device having a transfer unit rotating about an axis inclined with respect to the bed, and which picks up the cigarette portions from the bed and feeds them respectively into first and second seats of a drum conveyor; the first and second seats being arranged respectively along a circular first path and a circular second path coaxial with a common axis; and drums being provided to transfer the second cigarette portions from the second path to a path defined by the input roller of the filter assembly machine and common to the first and second cigarette portions.

8 Claims, 2 Drawing Sheets

DEVICE FOR TRANSFERRING CIGARETTE PORTIONS FROM A DUAL-ROD CIGARETTE MANUFACTURING MACHINE TO A FILTER ASSEMBLY MACHINE

BACKGROUND OF THE INVENTION

The present invention relates to a device for transferring cigarette portions from a dual-rod cigarette manufacturing machine to a filter assembly machine.

On dual-rod cigarette manufacturing machines, the two rods, once formed, are fed parallel to each other along a normally horizontal output bed; and, as they travel along the bed, the rods are fed through a cutting station where they are cut transversely into portions of equal length, which continue traveling along the bed in the same direction as the rods.

When producing filter-tipped cigarettes, the cigarette portions are transferred by a transfer device from the bed to a filter assembly machine, the input station of which is normally defined by a drum conveyor positioned with its axis parallel to the rods, and comprising outer axial grooves, each for receiving at least one cigarette portion.

In U.S. Pat. No. 5,255,777, the cigarette portions are transferred from the output bed of the manufacturing machine to the filter assembly machine by means of a transfer device comprising a transfer drum rotating about an axis parallel to the cigarette portions, and a number of pickup units facing the transfer drum and each comprising two seats. Each pickup unit is movable in such a manner as to keep the respective seats parallel to themselves at all times, and to feed the seats along a first and a second path lying in planes perpendicular to the bed and at different distances from the transfer drum; and each pickup unit picks up one cigarette portion of one rod and the corresponding cigarette portion of the other rod, and feeds the two cigarette portions along a portion of said paths and into two adjacent seats formed on the transfer drum.

To receive both the cigarette portions picked up by each pickup unit, one of the seats in each pair of adjacent seats on the transfer drum is fitted to a lever, which is activated by a cam device to vary the distance between the seat and the axis of the transfer drum, and so enable the seat to receive the cigarette portion traveling along the path furthest from the outer surface of the transfer drum.

Once the pair of cigarette portions has been deposited, the lever is withdrawn to bring the seat back onto the outer surface of the transfer drum, which then transfers the cigarette portions to the input drum conveyor of the filter assembly machine.

The above device involves considerable drawbacks on account of the levers, which make the transfer drum mechanically complex and, hence, unreliable and relatively expensive to produce.

In U.S. Pat. No. 5,267,577, pairs of cigarette portions are transferred using a transfer device in which the seats of the pickup units describe a first and a second path similar to those described above. In this case, however, the transfer conveyor comprises a first and a second drum comprising respective seats for receiving the cigarette portions. More specifically, the first drum is in the form of a cage rotating about a first axis and about the second drum, which rotates about a second axis separated from the first axis by such a distance that the seats of the first and second drums respectively describe a third and a fourth circular path. The two paths are respectively tangent to the first and second paths to receive the cigarette portions from each pickup unit, and are also tangent to each other at a point in which the third and fourth paths are tangent to the input drum conveyor of the filter assembly machine.

The above transfer device provides for effectively transferring pairs of cigarette portions from the bed of a manufacturing machine to the input drum conveyor of a filter assembly machine, but has the disadvantage of comprising a high-cost, structurally complex transfer drum.

SUMMARY OF THE INVENTION

It is an object of the present invention to provide a device for transferring cigarette portions from a manufacturing machine to a filter assembly machine, and which is structurally straightforward and involves none of the aforementioned drawbacks.

According to the present invention, there is provided a device for transferring cigarette portions from a dual-rod manufacturing machine to a filter assembly machine; the device being interposed between a conveying plane of an output bed of the manufacturing machine and an input conveyor of the filter assembly machine, and comprising a succession of first seats and a succession of second seats alternating with each other, said first and second seats respectively receiving first and second cigarette portions, and being arranged respectively along a circular first path and a circular second path of different radii; and a transfer unit rotating about a first axis to pick up a succession of pairs of first and second cigarette portions off said bed, and feed the first and second cigarette portions in each pair respectively into a said first seat and into a said second seat; characterized in that said first and second seats are carried on a transfer drum rotating about a second axis coaxial with said first and second paths; the first axis being inclined with respect to the conveying plane of said bed; and output conveying means being provided to transfer the second cigarette portions from the second path to a path defined by said input conveyor and common to said first and second cigarette portions.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
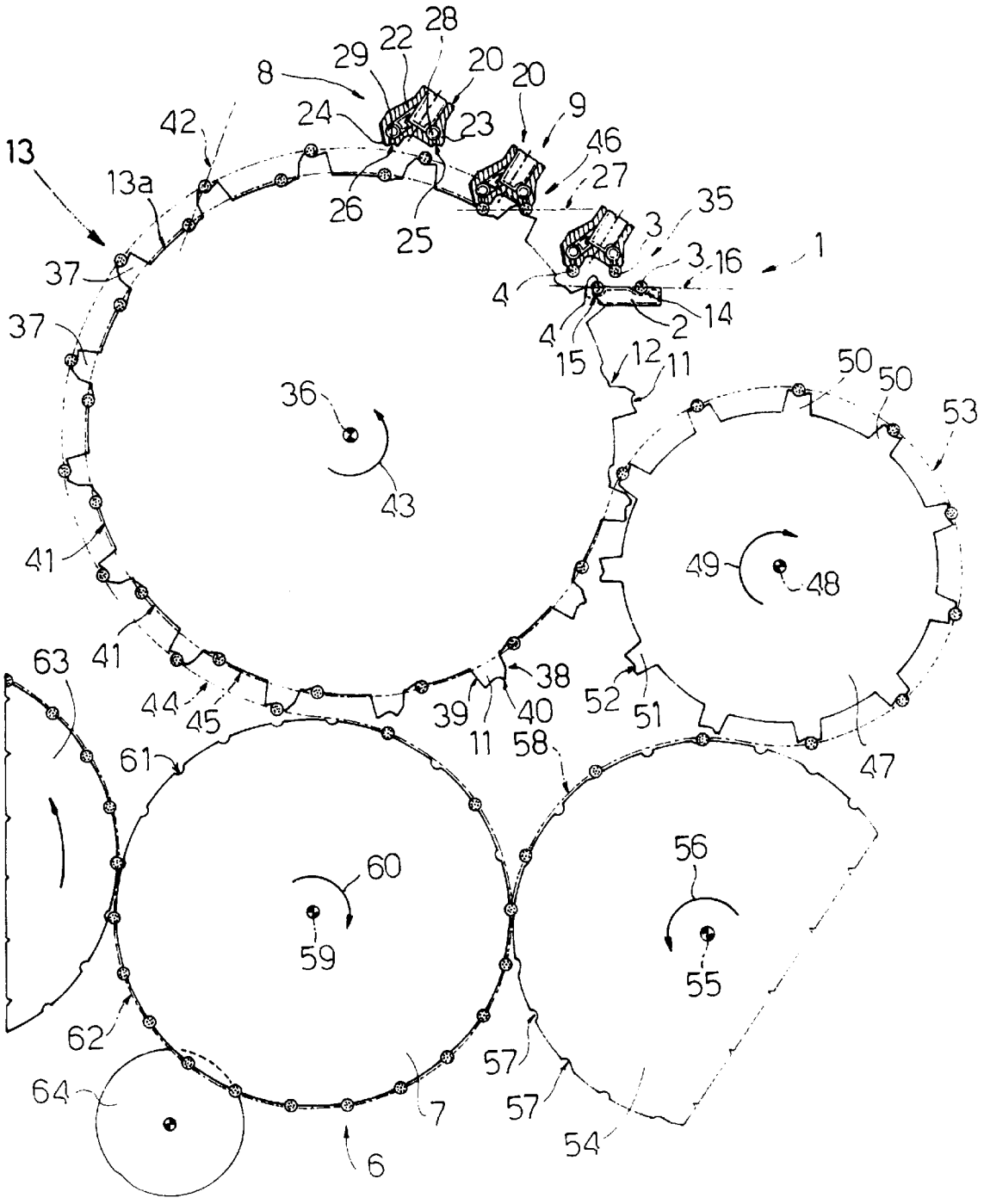
FIG. 1 shows, schematically, a preferred embodiment of the device according to the present invention.

Number 1 in FIG. 1 indicates a dual-rod cigarette manufacturing machine of the type described and illustrated in U.S. Pat. No. 4,418,705, to which full reference is made herein in the interest of full disclosure.

Machine 1 comprises an output bed 2 along which two continuous cigarette rods (not shown) are fed at the same substantially constant axial speed, and are cut by a known rotary cutting head (not shown) into respective portions 3 and 4.

The speed of the cutting head (not shown) is such that portions 3 and 4 are twice the length of the tobacco-filled portion of a single cigarette, and the mentioned cigarette rods are fed along bed 2 in an axial direction 5.

Number 6 in FIG. 1 indicates a filter assembly machine, the input roller 7 of which is connected to bed 2 of machine 1 by a transfer device or assembly indicated as a whole by 8 and for successively transferring portions 3 and 4 from bed 2 to machine 6.

Figure 3:
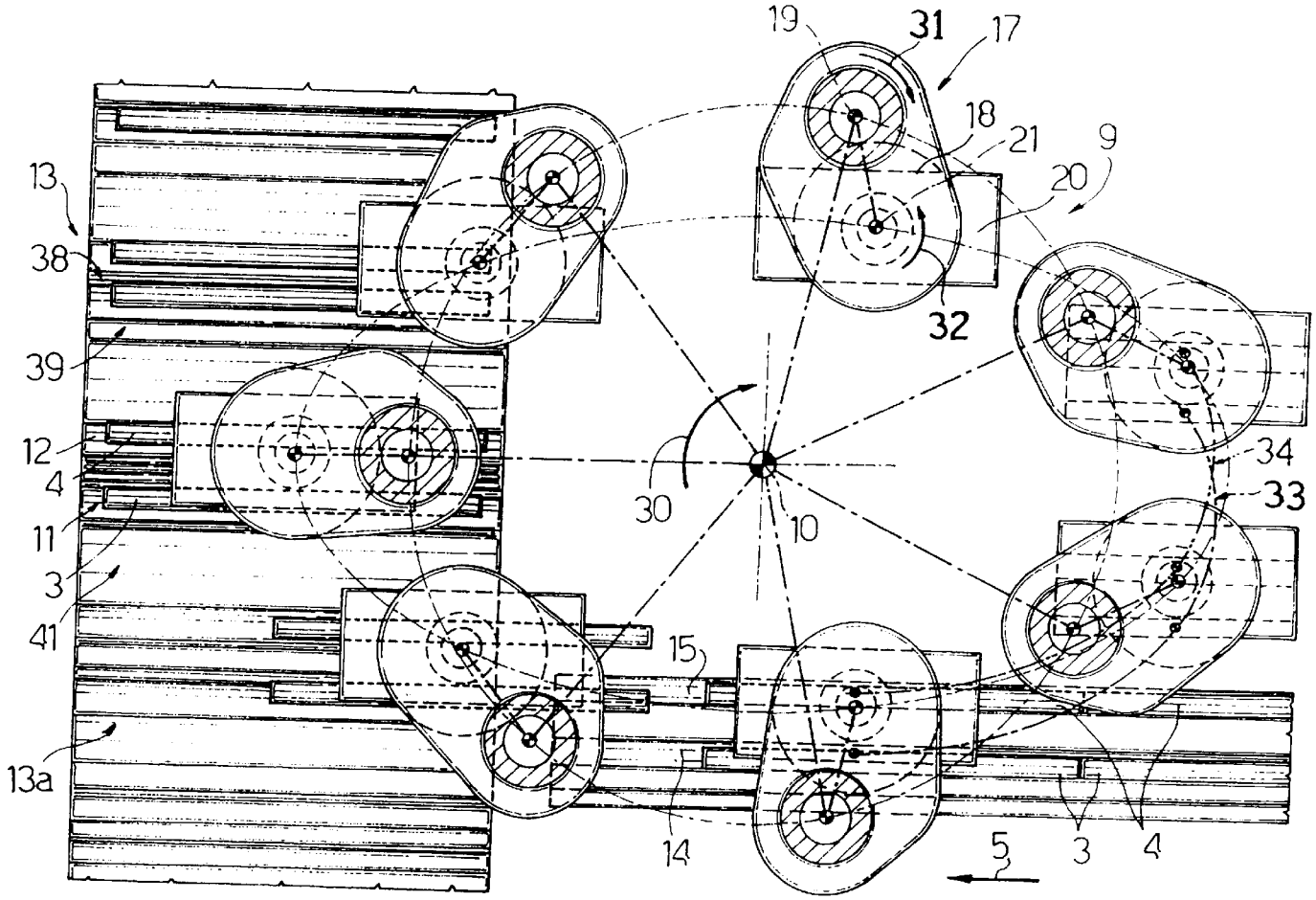
FIG. 3 shows a view perpendicular to the axis of rotation of the pickup heads.

As shown in FIGS. 1 and 3, bed 2 terminates beneath a rotary transfer unit 9 forming part of transfer device 8, and which, rotating about a respective axis 10 inclined with respect to bed 2, transfers portions 3 and 4 successively into respective seats 11 and 12 on a drum 13 also forming part of transfer device 8.

As shown in FIG. 1, bed 2 is substantially horizontal, and comprises two upper longitudinal grooves 14 and 15, which are engaged in sliding manner by respective portions 3 and 4, and the respective parallel axes of which define the conveying plane 16 of portions 3 and 4.

As shown in FIG. 3, unit 9 comprises a number of heads 17 equally spaced about axis 10; and each head 17 comprises a shoe 18 rotating about an axis 19 parallel to axis 10, and a pickup unit 20 fitted to shoe 18 to rotate about an axis 21 parallel to axes 10 and 19.

Figure 2:
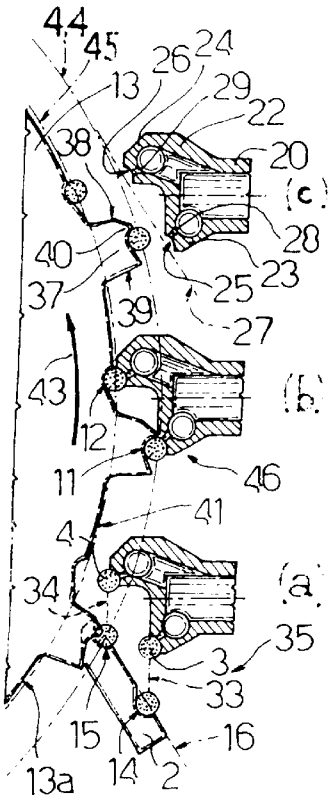
FIG. 2 shows a detail of FIG. 1.

As shown in FIG. 2, each pickup unit 20 comprises a body 22, in turn comprising two ribs 23 and 24 along which are formed respective longitudinal seats 25 and 26 defining a movable transfer plane 27 parallel to plane 16. Seats 25 and 26 of each body 22 retain respective portions 3 and 4 by means of respective suction holes 28 and 29, and are spaced in the same way as longitudinal grooves 14 and 15.

Unit 9 comprises a known epicyclic transmission (not shown), which, as unit 9 rotates about axis 10 in the direction of arrow 30, rotates each shoe 18 about respective axis 19 in the direction of arrow 31, and rotates pickup unit 20, with respect to shoe 18, about respective axis 21 in the direction of arrow 32, so that seats 25 and 26 are maintained parallel at all times to grooves 14 and 15, and travel respectively along a first and second annular path 33 and 34 extending about axis 10. As seats 25 and 26 are transferred along respective annular paths 33 and 34, plane 27 defined by each pair of seats 25, 26 is maintained parallel at all times with plane 16, and becomes coincident with plane 16 at a pickup station 35 over bed 2.

Drum 13 comprises a substantially cylindrical outer surface 13*a*, rotates at constant angular speed about an axis 36 parallel to grooves 14 and 15, and is positioned facing unit 9.

A number of ribs 37, parallel to and equally spaced about axis 36, project radially from surface 13*a* of drum 13; each rib 37 comprises a front face 38, a rear face 39, and a free end 40; and each free end 40 comprises one of said seats 11 for receiving and retaining a respective cigarette portion 3 by means of a known suction device (not shown).

Ribs 37 define on surface 13*a* a succession of cylindrical surface sectors 41, each comprising, close to the front face 38 of a respective adjacent rib 37, a respective seat 12 for receiving and retaining a respective cigarette portion 4 by means of a known suction device (not shown). Each seat 11 forms, with the adjacent seat 12 in front, a pair of adjacent seats 11 and 12 separated by a distance equal to that between grooves 14 and 15 and to that between seats 25 and 26 of each pickup unit 20, and the pairs of adjacent seats 11, 12 are equally spaced.

Moreover, each pair of adjacent seats 11 and 12 defines a movable transfer plane 42 parallel to axis 36, and which may assume an infinite number of positions about axis 36 as drum 13 is rotated.

As drum 13 rotates about axis 36, seats 11 and 12, traveling in the direction of arrow 43 in FIG. 2, describe about axis 36 circular first and second paths 44 and 45 respectively tangent to annular first and second paths 33 and 34.

As drum 13 rotates and each pair of successive adjacent seats 11 and 12 is fed into a given angular position, the plane 42 defined by the pair is positioned parallel to plane 16 and parallel to and coincident with the movable transfer plane 27 defined by the pair of seats 25 and 26 of a given pickup unit 20, so as to define a transfer station 46 where portions 3 and 4 are transferred simultaneously from seats 25 and 26 to seats 11 and 12.

FIG. 2 shows three successive pickup units 20 with respective seats 25 and 26 traveling along paths 33 and 34 and in different positions ( (a), (b), (c) ) with respect to drum 13. In position (a), pickup unit 20 approaches outer surface 13*a* of drum 13 after picking up portions 3 and 4 from bed 2 at pickup station 35; in position (b), pickup unit 20 is located at transfer station 46, where portions 3 and 4 are transferred from seats 25 and 26 into seats 11 and 12; and, in position (c), pickup unit 20 is withdrawn away from drum 13.

Transfer device 8 also comprises a drum 47 rotating about an axis 48 in the direction of arrow 49 in FIG. 1, and in turn comprising a succession of ribs 50 equally spaced about the outer surface of drum 47. The free end 51 of each rib 50 comprises a longitudinal seat 52; seats 52 are arranged about axis 48 with the same spacing as seats 12, and travel with drum 47 along a circular path 53; and the radial extension of each rib 50 is substantially equal to that of ribs 37 of drum 13.

Device 8 also comprises a drum 54 rotating about an axis 55 in the direction of arrow 56 in FIG. 1, and in turn comprising a substantially cylindrical outer surface on which are equally spaced a number of seats 57 traveling with drum 54 along a circular path 58.

Input roller 7 of filter assembly machine 6 rotates about an axis 59 in the direction of arrow 60 in FIG. 1, and the surface of roller 7 comprises a number of seats 61 parallel to axis 59, equally spaced about axis 59 with the same spacing as seats 57, and traveling with roller 7 along a circular path 62.

Axes 36, 48, 55 and 59 of respective drums 13, 47, 54 and roller 7 are parallel to one another and so located that path 53 is tangent to paths 45 and 58, and path 62 is tangent to paths 58 and 44.

Once portions 3 and 4 are deposited inside respective seats 11 and 12, portions 3 are fed along a portion of path 44 and transferred into respective seats 61 on roller 7, and portions 4 are fed along a portion of path 45 and transferred into respective seats 52 on drum 47, the ribs 50 of which provide for picking up portions 4 from seats 12 formed in sectors 41. Portions 4 are then transferred into seats 57 on drum 54, which provides for transferring portions 4 into seats 61 on roller 7.

On roller 7, portions 3 and 4 are housed inside seats 61 and finally all lie along the same circular path 62, and are subsequently transferred, inside machine 6, to follow-up rollers, one of which is indicated 63 in FIG. 1.

As they are fed along machine 6, portions 3 and 4 are subjected to a series of known operations. FIG. 1, for example, shows a rotary blade 64 for cutting portions 3 and 4 into two halves as they travel along path 62.

Transfer device 8 is particularly advantageous by comprising low-cost transfer drums 13, 47, 54 of extremely straightforward design, and which provide, with substantially no problems, for achieving relatively high output speeds.

We claim:

1. A device for transferring cigarette portions (3, 4) from a dual-rod manufacturing machine (1) to a filter assembly machine (6); the device being interposed between a conveying plane (16) of an output bed (2) of the manufacturing machine (1) and an input conveyor (7) of the filter assembly machine (6), and comprising a succession of first seats (11) and a succession of second seats (12) alternating with each other, said first and second seats (11, 12) respectively receiving first (3) and second (4) cigarette portions, and being arranged respectively along a circular first path (44) and a circular second path (45) of different radii; and a transfer unit (9) rotating about a first axis (10) to pick up a succession of pairs of first and second cigarette portions (3, 4) off a bed (2), and feed the first (3) and second (4) cigarette portions (3, 4) in each pair respectively into said first seat (11) and into said second seat (12); characterized in that said first and second seats (11, 12) are carried on a transfer drum (13) rotating about a second axis (36) coaxial with said first and second paths (44, 45); the first axis (10) being inclined with respect to the conveying plane (16) of a bed (2); and output conveying means (47, 54) being provided to transfer such second cigarette portions (4) from the second path (45) to a path (62) defined by such an input conveyor (7) and common to such a first and second cigarette portions (3, 4).

2. A device as claimed in claim 1, characterized in that said drum (13) is so mounted that said circular first path (44) is tangent to said path (62) of such an input conveyor (7) to transfer such first cigarette portions (3) from said circular first path (44) to a path (62) of such an input conveyor.

3. A device as claimed in claim 1, characterized in that said second axis (36) is located below such a conveying plane (16).

4. A device as claimed in claim 1, characterized in that said transfer drum (13) comprises a substantially cylindrical outer surface, and a succession of radial ribs (37) projecting outwards from said outer surface and equally spaced about said second axis (36) to divide said outer surface into sectors (41) of equal size; each said first seat (11) being formed on a free end of a respective said rib (37); and each said second seat (12) being formed on a respective said sector (41).

5. A device as claimed in claim 4, characterized in that each said second seat (12) is formed, on the respective said sector (41) and in a rotation direction (43) of said transfer drum (13), close to a front lateral surface (38) of the rib (37) comprising the respective said first seat (11).

6. A device as claimed in claim 4, characterized in that said transfer unit (9) comprises a number of pickup units (20) equally spaced about said first axis (10), and each comprising a third and a fourth seat (25, 26) coplanar with a first movable transfer plane (27); each pickup unit (20) being movable about said first axis (10) to move the respective two seats (25, 26) along respective annular pickup paths (33, 34) extending about the first axis (10); each first seat (11) and the respective second seat (12) defining a second movable transfer plane (42); and said two movable planes (27, 42) coinciding with each other in a given angular position of the transfer drum (13) and in a given angular position of the respective pickup unit (20).

7. A device as claimed in claim 1, characterized in that said output conveying means (47, 54) comprise a first output drum (47) tangent to said circular second path (45) and comprising seats (52) for receiving said second cigarette portions (4).

8. A device as claimed in claim 7, characterized in that said transfer drum (13) is so mounted that said circular first path (44) is tangent to said input conveyor (7) of the filter assembly machine (6); said output conveying means (47, 54) comprising a second output drum (54) comprising seats (57) for receiving said second cigarette portions (4) and arranged along a path (62) tangent to the first output drum (47) and also tangent to said circular first path (44) when the circular first path (44) is tangent to such an input conveyor (7).

* * * * *

UNITED STATES PATENT AND TRADEMARK OFFICE

CERTIFICATE OF CORRECTION

PATENT NO. : 5,908,030

DATED : June 1, 1999

INVENTOR(S) : DANIELE COI, ET AL.

It is certified that error appears in the above-identified patent and that said Letters Patent is hereby corrected as shown below:

On the title page, insert the followings:

[30] Foreign Application Priority Data

October 24, 1996 [IT] Italy..... BO96A 000535

Signed and Sealed this

Thirtieth Day of November, 1999

*Attest:*

*Attesting Officer*

Q. TODD DICKINSON

*Acting Commissioner of Patents and Trademarks*